US010603714B2

(12) United States Patent
Montero et al.

(10) Patent No.: US 10,603,714 B2
(45) Date of Patent: Mar. 31, 2020

(54) METHOD AND DEVICE FOR PRODUCING A CASTING MOLD FOR SAND CASTING

(71) Applicant: KUENKEL WAGNER GERMANY GMBH, Alfeld/Leine (DE)

(72) Inventors: Gelson G. Montero, Alfeld (DE); Ralf Schulze, Alfeld (DE)

(73) Assignee: KUENKEL WAGNER GERMANY GMBH, Alfeld, Leine (DE)

( * ) Notice: Subject to any disclaimer, the term of this patent is extended or adjusted under 35 U.S.C. 154(b) by 196 days.

(21) Appl. No.: 15/559,933

(22) PCT Filed: Aug. 4, 2015

(86) PCT No.: PCT/DE2015/200433

§ 371 (c)(1),
(2) Date: Feb. 22, 2018

(87) PCT Pub. No.: WO2016/150413

PCT Pub. Date: Sep. 29, 2016

(65) Prior Publication Data

US 2018/0169746 A1 Jun. 21, 2018

(30) Foreign Application Priority Data

Mar. 20, 2015 (DE) ..... 10 2015 205 058

(51) Int. Cl.
*B22C 15/08* (2006.01)
*B22C 9/02* (2006.01)

(52) U.S. Cl.
CPC ..... *B22C 15/08* (2013.01); *B22C 9/02* (2013.01)

(58) Field of Classification Search
CPC ..... B22C 15/08; B22C 9/02
See application file for complete search history.

(56) References Cited

U.S. PATENT DOCUMENTS 4,254,816 A * 3/1981 Geiger ..... B22C 15/08 164/173
4,598,756 A * 7/1986 Fuchigami ..... B22C 15/08 164/172

(Continued)

FOREIGN PATENT DOCUMENTS

EP 0295472 12/1988
JP S7142743 9/1982

(Continued)

OTHER PUBLICATIONS

International Search Report, International Application No. PCT/DE2015/200433, dated Dec. 10, 2015, pp. 1-3.

*Primary Examiner* — Mary Lynn F Theisen
(74) *Attorney, Agent, or Firm* — Greenberg Traurig LLP

(57) ABSTRACT

Methods and devices for producing a casting mold for sand casting are disclosed. In one embodiment, a method for producing a compacted mold for casting molten material may include positioning a model or pattern in a flask; filling the flask with compactable sand; and compacting the compactable sand around the model or pattern so as to form a compacted mold or compacted mold component suitable for casting. The compacting of the molding sand takes place in zones or regions smaller than a lateral extension of the flask based on a contour or a dimension of the model or pattern.

15 Claims, 4 Drawing Sheets

(56) References Cited

U.S. PATENT DOCUMENTS

| | | | | |
|---|---|---|---|---|
| 4,915,159 | A * | 4/1990 | Damm | B22C 15/08 164/154.2 |
| 4,976,303 | A | 12/1990 | Wuepper | |
| 5,682,941 | A * | 11/1997 | Oda | B22C 15/08 164/154.2 |
| 6,470,953 | B1 * | 10/2002 | Hirata | B22C 15/08 164/154.1 |
| 2003/0010468 | A1 * | 1/2003 | Kaneto | B22C 15/08 164/195 |
| 2003/0098137 | A1 * | 5/2003 | Kaneto | B22C 15/08 164/37 |

FOREIGN PATENT DOCUMENTS

| | | |
|---|---|---|
| JP | S60115346 | 6/1985 |
| JP | 2003205347 | 7/2003 |

* cited by examiner

METHOD AND DEVICE FOR PRODUCING A CASTING MOLD FOR SAND CASTING

FIELD OF INVENTION

The invention relates to a method and a device for producing a casting mold for sand forming or casting, wherein a model (pattern) is positioned in a molding flask (in short "flask") and the flask is filled with molding sand (green or moist sand—sand, bentonite and water, configured to be compacted by force), and wherein the molding sand (in short "sand") is compacted around the model or pattern so as to form a compacted mold or mold component suitable for casting molten material (castable materials).

BACKGROUND OF THE INVENTION

The method in question serves to produce a casting mold for sand casting and called "mold production process". The term mold production process represents various methods of producing a casting mold used for producing workpieces from castable materials. In this context, there are different methods differing from one another e.g. insofar as whether the sand mold is produced by hand or by a machine (hand molding, machine molding), whether the sand mold is destroyed during the casting process or is repeatedly usable (lost molds, permanent molds) and whether the models used are disposable models (lost models, investment casting and full-mold casting) or permanent models (hand molding, machine molding, mask molding, vacuum molding) or whether no models are used (continuous casting, die casting, etc.).

At any rate, what is here dealt with is the production of a casting mold that is based on a model of the workpiece to be cast.

For producing such a mold, a molding flask is required, which, like the model, may e.g. be bipartite. Hence, two molding flask halves may be provided. The molding flasks are normally open at the top and at the bottom. The sand used is pourable and has a plastic condition. In classical sand casting processes, the sand is encompassed by or mixed with fine clay or bentonite. The sand-clay mixture is mixed with water. This is referred to as clay-bound or bentonite-bound sand. This moist sand is often also referred to as green sand.

The sand is poured around the model and compacted. After having been compacted, the sand adheres to the inner wall of the flask and defines a negative of the model contour.

The more detailed the model is, the more precisely and carefully the sand must be poured around the model and compacted.

According to the prior art known in practice, compacting is carried out, irrespectively of the model and the contour, via a large head covering the molding flask and comprising compacting cylinders. This has the effect that the sand above the model will be compacted more highly than the sand at the sides of the model, viz. due to the longer distance along which compacting takes place at the sides. In the final analysis, no attention was paid to the effect which the presence of the model in the molding flask has on the compaction of the molding sand around the model. Compacting was carried out unidirectionally without taking into consideration the contour of the model.

SUMMARY OF THE INVENTION

In accordance with the above statements, the above explained green sand process was not used for large workpieces, in particular not for workpieces having a complex surface structure. Instead of using green sand, it is possible to add/mix to the molding sand a chemical binding agent that reacts and hardens, respectively, under thermal influence. In this way, stable casting molds can be produced at only low pressures under thermal influence. Due to the chemical binding agents used, this method (e.g., "no-bake molds") is detrimental to the environment, viz. due to the mixing of sand and binding agent. It is normally argued that the use of molding sand with a binding agent is justified insofar as, in the case of large molds and correspondingly large molding flasks, a homogeneous compacting of the classical green sand for defining the mold is no longer reliably possible.

There is a need to implement and further develop a method and a device for producing a sand mold for casting such that, irrespectively of the size of the model and/or of the workpiece to be cast and irrespectively of complex contours/surfaces, the classical green sand method can be used for producing the casting mold while achieving a sufficiently good quality of the casting mold. The use of chemical binding agents is to be avoided.

According to these needs, the method for producing a casting mold for casting is preparing the compacting of the molding sand in certain zones or regions, taking into account the contour and/or the dimensions of the model/pattern.

According to the needs, the device is configured to compacting of the sand around the model in certain zones or regions, taking into account the contour and/or the dimensions of the model, wherein a compacting unit includes a compacting head comprising a plurality of compacting cylinders.

According to the present invention, it has been realized that, also in the case of large, complex models and/or workpieces to be cast, the classical green sand method may be used, according to which the moist molding sand (green sand) is filled in around the model, without any chemical binding agent, and compacted, and thus consolidated so as to form a casting mold. This is made possible by taking into account the contour and/or the dimensions of the model placed in the molding flask, when filling in and compacting the molding sand.

Contrary to former methods and practice, the molding sand contained in the molding flask is not compacted approximately uniformly across the entire surface, but areas are taken into consideration where the model is located, in contrast to areas that are exclusively filled with molding sand down to the bottom of the molding flask, without any other parts being located therein. The last mentioned areas allow, related to the volume of the molding flask, much higher compacting of the molding sand than the areas where the model is located.

In the final analysis, the teaching according to the present invention claims that the molding sand should, area wise, have applied thereto different pressing forces, as allowed by the aimed-at tap or green density of the sand, starting from an original bulk density.

For realizing the method according to the present invention, it is imaginable that the molding sand is filled gradually, so to speak layer by layer, into the molding flask. This takes first place around the model, and is carried out successively until the entire model is embedded in the compacted molding sand. Then, layers are applied on top. In so doing, the situation that sand layers above the model make up a smaller volume than the sand layers located at the sides of the model must be taken into account. The pressing forces and strokes required for compacting are rated accordingly.

Compacting of the molding sand is carried out via a compacting unit comprising one or a plurality of compacting cylinders. The compacting cylinders may have identical or different diameters, compacting cylinders having different diameters being suitable for causing area wise different degrees of compaction of the molding sand.

In addition, it will be of advantage when compacting takes place in a plurality of successive compression strokes, in that a sort of tamping of the molding sand is realized via the compression cylinders, such tamping taking place at the sides of the respective model and resulting in higher compaction than in the area of the contours of the model.

It is also imaginable that the filling of the molding flask and the compacting take place in a plurality of, preferably alternating, operating steps, such that, after a certain degree of compaction, additional molding sand is filled into the molding flask, whereupon another compacting step of this additional molding sand is carried out.

In an advantageous manner, molding sand is refilled purposefully after individual zonal or local compression strokes, such refilling being carried out at locations where, in the absence of a model lying below the molding sand, a greater bulk of molding sand can be compacted due to the volume available.

With due regard to the teaching according to the present invention, it will be of advantage that the compacting unit comprising the compacting cylinders need not have approximately the size of the molding flask. On the contrary, the compacting unit comprising the compacting cylinders may be positioned in a comparatively small-sized embodiment, i.e. an embodiment according to the number of compacting cylinders, above the molding flask via a portal, a bridge or a robot, and may undergo a change in position in the area of the molding flask. The compacting unit can thus be moved in space in the area of the molding flask, the compacting unit as a whole being here movable in the direction of the molding sand and each compacting cylinder being, when seen individually, movable in the direction of the molding sand in the sense of a compacting stroke. Any spatial coordinate can be accessed via the portal or a robot, so that different compacting strokes can be executed at predeterminable locations.

In addition, it is of essential importance that the compacting unit and thus the individual compacting cylinders are controlled via a computer/processor, the control program taking into account the contour of the model with respect to the pressing force and the stroke, and also with respect to the number of strokes, and taking especially also into account which distance, calculated from the base of the molding flask, is available for the purpose of filling and compacting, the respective distance being reduced by the dimensions of the model inserted. The method according to the present invention allows optimum compacting of the molding sand around the model, irrespectively of the size and the design of the model and, consequently, also irrespectively of the size of the molding flask, making use of the compacting unit carried e.g., by a portal.

Due to multiple individual compression strokes, the compacting is very similar to manual tamping of the type carried out formerly around the respective model in the case of manual compaction of the molding sand, at that time according to visual judgment and by guess.

The device according to the present invention uses the method according to the present invention, with a compacting unit including a compacting head that comprises a plurality of compacting cylinders. The projected area of the compacting unit may be smaller than the base area of the molding flask, since the compacting unit may be carried by a portal, a bridge or a robot, which positions the compacting unit at an arbitrary location above the molding flask and changes also the position thereof according to a predeterminable compacting program for operating the compacting cylinders. The compacting head is movable in space, i.e. three-dimensionally, and positionable above the molding flask in an arbitrary manner, so that it will be able to operate or trigger each individual compacting cylinder from any position with a predeterminable compacting force and a predeterminable stroke.

In addition, it is important that, irrespectively of the position of the head relative to the molding flask, each of the cylinders is vertically movable so as to execute the compacting stroke.

The cylinders of the compacting unit are, advantageously, arranged symmetrically in accordance with a matrix and can be operated individually and/or in common, according to requirements, with different strokes and different pressing forces.

It should be pointed out that the necessary hydraulic system may be associated with the portal or the bridge or the robot, through which the compacting unit is carried and positioned. This allows a compact structural design.

There are various possibilities of implementing and further developing the teaching according to the present invention in an advantageous manner. In this context, reference is made, on the one hand, to the claims following claims and, on the other hand, to the explanation of a preferred embodiment of the present invention following herein, making reference to the drawings.

INTRODUCTION OF THE DRAWINGS

In connection with the explanation of the preferred embodiment of the invention with reference to the drawings, also generally preferred embodiments and further developments of the teaching will be explained. In the drawing.

DETAILED DISCLOSURE

Figure 1:
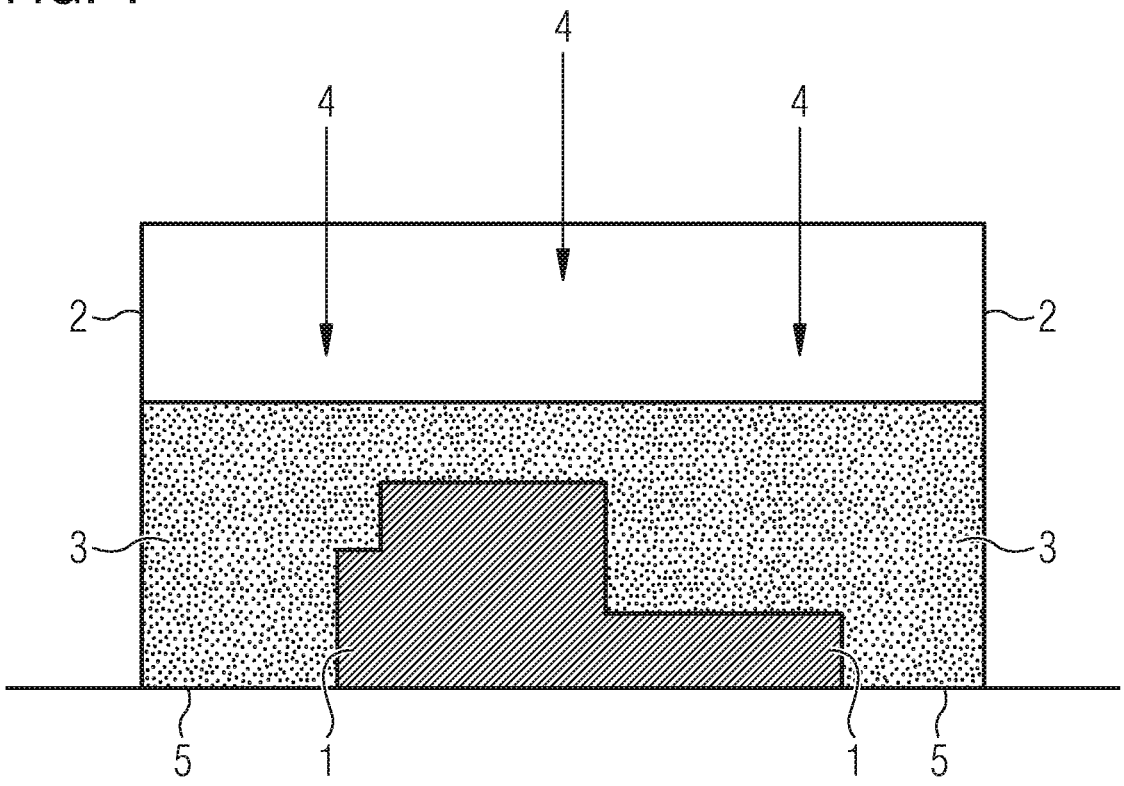
FIG. 1 shows, in a schematic view, the fundamental arrangement of a model in a molding flask, with molding sand being filled in around the model and compacted.

FIG. 1 shows, in a highly schematized view, the fundamental arrangement of a model 1 in a molding flask 2. When the model 1 has been positioned, the molding flask 2 is successively filled with molding sand (green sand) 3, the molding sand 3 being compacted around the model 1 so as to form a stable mold suitable for casting.

The arrows 4 indicate that the compacting of the molding sand 3 takes place in certain zones or regions, through cylinders that are not shown in FIG. 1, taking into account the contour and/or dimensions of the model 1. Insofar, it is taken into consideration whether the molding sand 3 extends, unhindered, from the molding flask base 5 upwards or whether the molding sand 3 extends from the surface of the model 1 upwards, viz. over a much shorter distance than from the molding flask base 5.

Figure 2:
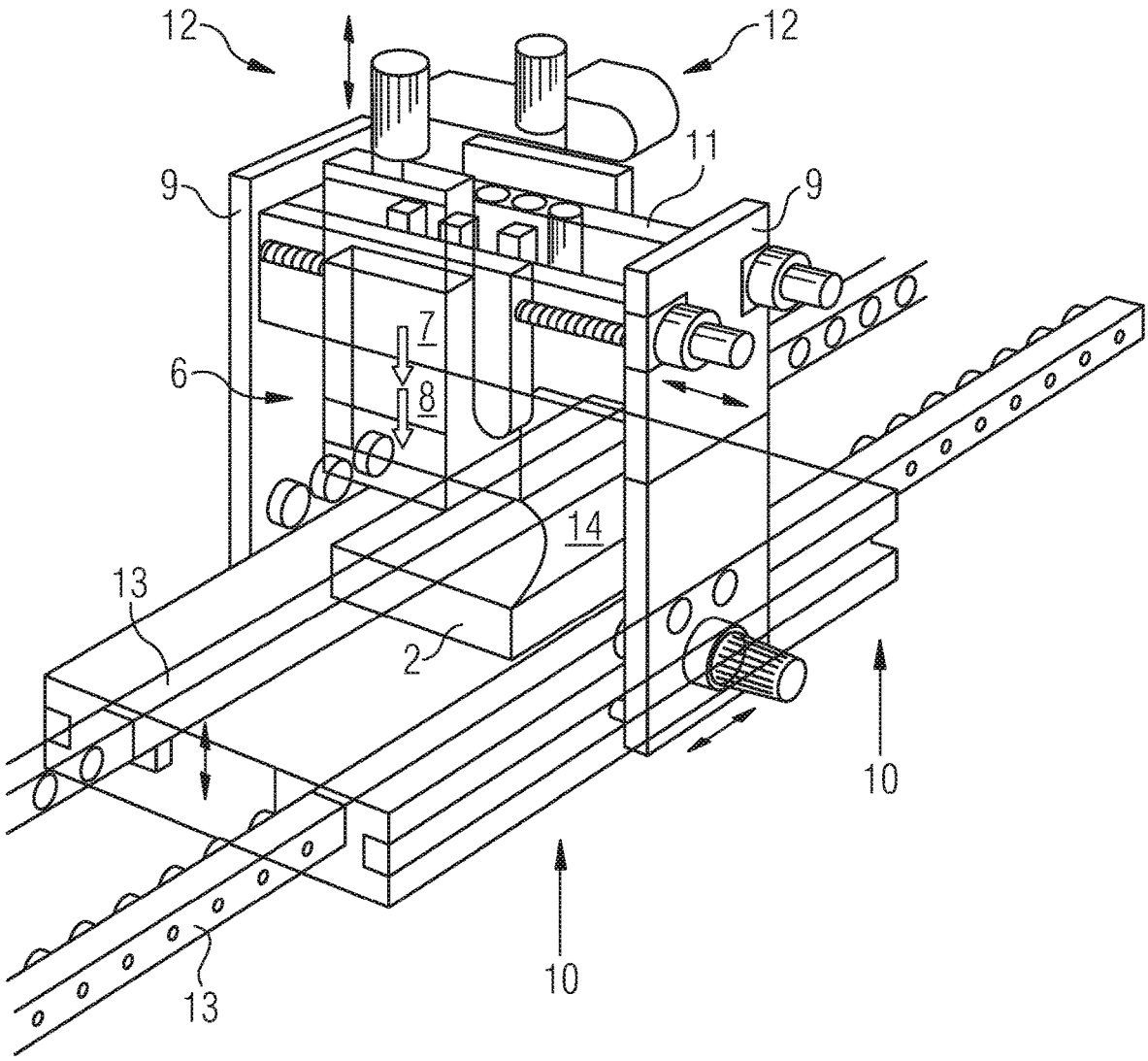
FIG. 2 shows, in a schematic view, an embodiment of a device according to the present invention whose compacting unit is positionable above and along a molding flask.

FIG. 2 shows, in a schematic view, the fundamental structural design of an embodiment of a device according to the present invention used for producing a casting mold for sand casting, wherein the model 1 is positioned in a molding flask 2, in accordance with the representation shown in FIG. 1. For compacting the molding sand that is filled in, or is to be filled into the molding flask 2, a pneumatically operated compacting unit 6 is provided, which comprises a compacting head 7 with a plurality of compacting cylinders 8.

From FIG. 2 it can be seen that the compacting unit 6 is associated with a portal 9, or rather carried by the latter. The portal 9 is horizontally movable along a guide unit 10, linearly along the molding flask 2.

The entire compacting head 7, together with the compacting cylinders 8, is movable on the portal 9 in a direction transversely to the guide unit 10, viz. along a portal guide 11.

In addition, the compacting head 7 is vertically movable on the portal 9, each of the compacting cylinders 8 being, when seen individually, displaceable and movable in the compacting direction.

According to the above statements, it can clearly be seen that the size or longitudinal dimensions of the molding flask 2, and also its height, no longer play an important part. The compacting unit 6 with the compacting head 7 and the individual compacting cylinders 8 can now be moved across the molding flask 2 in an arbitrary manner, and, in so doing, the compacting cylinders 8 can be positioned for compacting the molding sand with due regard to the contour and the dimensions of the model.

From FIG. 2 it can also be seen that the hydraulic system 12 is associated with the portal 9, i.e. it is supported by the portal 9. This allows a compact structural design.

It is also imaginable that the guide unit 10, on which or in which the portal 9 is guided, is adjustable in width, so that different portals can be used or portals that are adjustable in width can be utilized.

In addition, the guide unit 10 may, when seen individually, be vertically adjustable, so that an optimum adaptation to the height of a molding flask 2, which is to be positioned between the guide elements 13 of the guide unit 10, can be carried out.

The drive for all the above-mentioned possibilities may be of a pneumatic and/or electrical nature. A hydraulic drive is imaginable as well.

Figure 3:
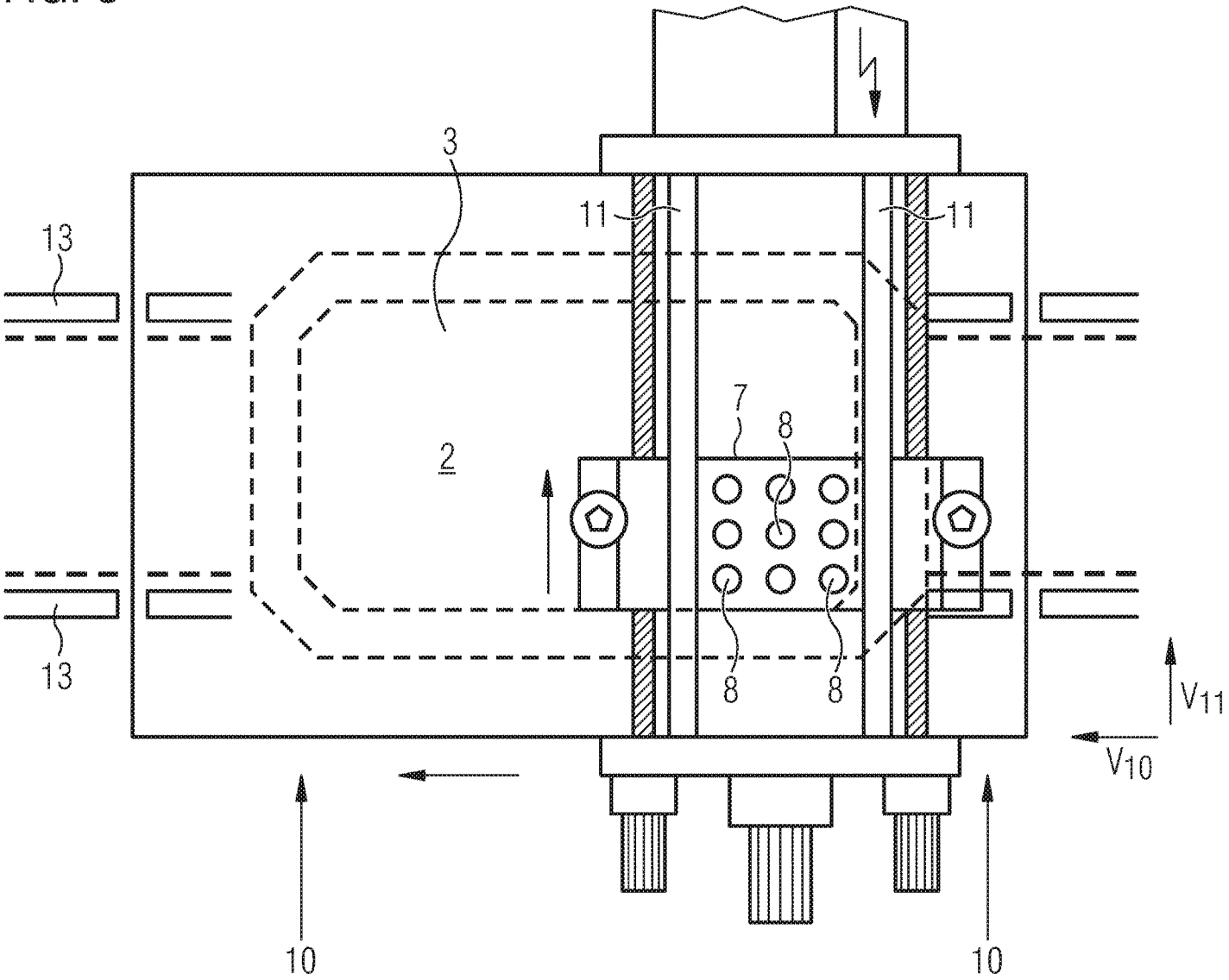
FIG. 3 shows, in a schematic top view, the device according to FIG. 2.

FIG. 3 shows the device according to FIG. 2 in a schematic top view, in which the molding flask 2 can again be discerned.

The portal guide 11 is configured as a crossbar. The compacting head 7 comprises a plurality of compacting cylinders 8 arranged in a matrix-like manner, the compacting cylinders 8 serving to compact the molding sand 3 contained in the molding flask 2.

Figure 4:
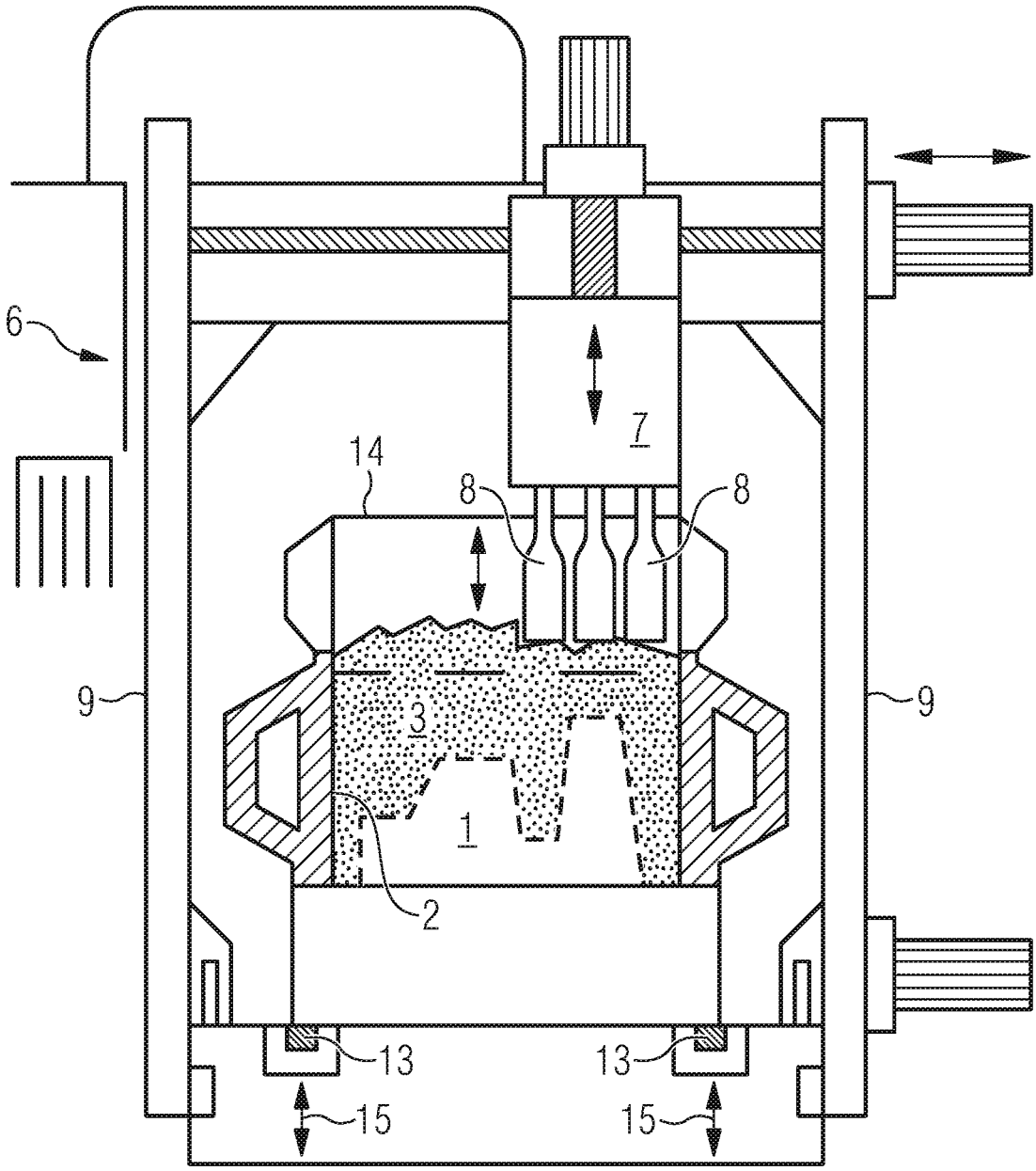
FIG. 4 shows, in a schematic front view, the device according to FIG. 2.

FIG. 4 shows the device according to FIG. 2 in a schematic front view, in which the molding flask 2 can again be seen. The model 1 is positioned in the molding flask 2 and covered by molding sand 3 to be compacted. In addition, FIG. 4 shows a filling aid 14 in the sense of a head attached to the actual molding flask 2, the compacting cylinders 8 of the compacting head 7 or compacting unit 6 projecting into the head in the case of an alternating application of pressure.

The arrows 15 indicate the vertical adjustability of the guide elements 13.

As regards additional advantageous further developments of the device according to the present invention, the general part of the description as well as the claims enclosed are referred to in order to avoid repetitions.

Finally, it should explicitly be pointed out that the above described embodiment of the device according to the present invention only serves to explain the teaching claimed, without limiting the teaching to this embodiment.

The invention claimed is:

1. A method for producing a compacted mold for casting molten material, comprising:

positioning a model or pattern in a flask;

filling the flask with compactable sand; and compacting the compactable sand around the model or pattern so as to form a compacted mold or compacted mold component suitable for casting, wherein the compacting of the molding sand takes place in zones or regions smaller than a lateral extension of the flask based on a contour or a dimension of the model or pattern, and wherein the compacting comprises a plurality of successive compression strokes.

2. The method of claim 1, wherein the compacting is performed by a compacting unit comprising a plurality of compacting cylinders.

3. The method of claim 2, wherein at least a majority of the compacting cylinders have an identical diameter.

4. The method of claim 1, wherein compactable sand is refilled following a compression stroke.

5. The method of claim 2, wherein a computer program controls a pressing force and a stroke of the compacting cylinders.

6. A method for producing a compacted mold for casting molten material, comprising:

positioning a model or pattern in a flask;

filling the flask with compactable sand; and compacting the compactable sand around the model or pattern so as to form a compacted mold or compacted mold component suitable for casting, wherein the compacting of the molding sand takes place in zones or regions smaller than a lateral extension of the flask based on a contour or a dimension of the model or pattern, wherein the step of filling the flask and the step of compacting the compactable sand comprises a plurality of steps.

7. A method for producing a compacted mold for casting molten material, comprising:

positioning a model or pattern in a flask;

filling the flask with compactable sand; and compacting the compactable sand around the model or pattern so as to form a compacted mold or compacted mold component suitable for casting, wherein the compacting of the molding sand takes place in zones or regions smaller than a lateral extension of the flask based on a contour or a dimension of the model or pattern, wherein the compacting cylinders are positioned above the flask via one of a portal, a bridge and a robot, and one of these undergoes a change in position near the flask.

8. A method for producing a compacted mold for casting molten material, comprising:

positioning a model or pattern in a flask;

filling the flask with compactable sand; and compacting the compactable sand around the model or pattern so as to form a compacted mold or compacted mold component suitable for casting, wherein the compacting of the molding sand takes place in zones or regions smaller than a lateral extension of the flask based on a contour or a dimension of the model or pattern, wherein a head providing the compacting is laterally smaller that the flask and provides a horizontal movement with multiple compacting by displacing the head.

9. A method for producing a compacted mold for casting molten material, comprising:

positioning a model or pattern in a flask;

filling the flask with compactable sand; and compacting the compactable sand around the model or pattern so as to form a compacted mold or compacted mold component suitable for casting, wherein the compacting of the molding sand takes place in zones or regions smaller than a lateral extension of the flask based on a contour or a dimension of the model or pattern, wherein the compactable sand is replenished at areas where the pattern or model has a small height and requires more sand volume.

10. A device for producing a compacted mold for casting a castable material, comprising:

a flask;

a model that is positioned in a flask;

wherein:

the flask is filled with sand;

a compacting unit comprising a compacting head having a plurality of compacting cylinders compacts the sand around the model so as to form a compacted mold suitable for casting using a molten material;

the compacting unit only partially compacts the sand around the model or pattern; and a part of the compacting is in a certain lateral zone of the flask based on a contour or a dimension of the model or pattern;

wherein the compacting unit comprises a portal, a bridge, or a robot that is adapted to be positioned above the flask and to undergo a change of position, wherein a head thereof being movable in space;

wherein the compacting head is movable in three dimensions, and is positionable above the flask in an arbitrary manner.

11. The device of claim 10, wherein the part of the compacting is smaller than a base area of the flask.

12. The device of claim 10, each of the compacting cylinders of the head is movable vertically independently of a position of a compacting head relative to the flask.

13. The device of claim 10, wherein the cylinders are arranged symmetrically in accordance with a matrix.

14. The device of claim 10, further comprising a hydraulic system associated with the portal.

15. The device of claim 10, wherein the part compacting is in the certain lateral zone and repeated to complete the lateral extension of the flask in other zones of the flask.

* * * * *